US006097348A

United States Patent [19]

Chen et al.

[11] Patent Number: 6,097,348

[45] **Date of Patent: *Aug. 1, 2000**

[54] COMPACT WAVEGUIDE HORN ANTENNA AND METHOD OF MANUFACTURE

[75] Inventors: Ming Hui Chen, Taipei; Chin-Yi Chu, Taipei Hsine, both of China

[73] Assignee: Victory Industrial Corporation, Taiwan

[ * ] Notice: This patent issued on a continued prosecution application filed under 37 CFR 1.53(d), and is subject to the twenty year patent term provisions of 35 U.S.C. 154(a)(2).

[21] Appl. No.: 09/081,495

[22] Filed: May 19, 1998

[51] Int. Cl.[7] ..... H01Q 19/12

[52] U.S. Cl. ..... 343/840; 343/775; 343/786

[58] Field of Search ..... 343/840, 786, 343/772, 775, 909, 910, 911 R, 756, 755, 781 R, 779; 330/286; 333/257; 29/600; H01Q 19/12

[56] References Cited

U.S. PATENT DOCUMENTS

| | | | |
|---|---|---|---|
| 3,045,238 | 7/1962 | Cheston | 343/786 |
| 3,949,404 | 4/1976 | Fletcher et al. | 343/786 |
| 4,477,816 | 10/1984 | Cho | 343/786 |
| 4,482,898 | 11/1984 | Dragone et al. | 343/786 |
| 4,511,868 | 4/1985 | Munson et al. | 333/257 |
| 4,588,962 | 5/1986 | Saito et al. | 330/286 |
| 4,604,624 | 8/1986 | Amitay et al. | 343/756 |
| 4,607,260 | 8/1986 | Dragone | 343/786 |
| 4,903,038 | 2/1990 | Massey | 343/786 |
| 5,576,721 | 11/1996 | Hwang et al. | 343/909 |

FOREIGN PATENT DOCUMENTS

| | | | |
|---|---|---|---|
| 1 219 872 | 1/1971 | United Kingdom | H01Q 13/02 |

OTHER PUBLICATIONS

"Radiation Pattern Analysis of Coaxial Cavity Feed Horn," Chang–Sik Kim and Allen W. Rhoden, 1986 APS Proceedings, pp. 95–98.

*Primary Examiner*—Don Wong
*Assistant Examiner*—Hoang Nguyen
*Attorney, Agent, or Firm*—Heller Ehrman White & McAuliffe LLP

[57] ABSTRACT

A parabolic rectangular horn antenna includes a source aperture, a parabolic reflector, and an output aperture. The source aperture has a first port for receiving a planar wavefront signal and a second port for providing a substantially cylindrical wavefront signal. The parabolic reflector is positioned within the horn to receive the cylindrical wavefront signal, transforming it to a substantially planar wavefront signal at a predefined location. The output aperture is positioned at the predefined location and outputs the substantially planar wavefront signal. Corrugations are adjacently placed at both sides of the output aperture to optimize the antenna beam pattern.

13 Claims, 11 Drawing Sheets

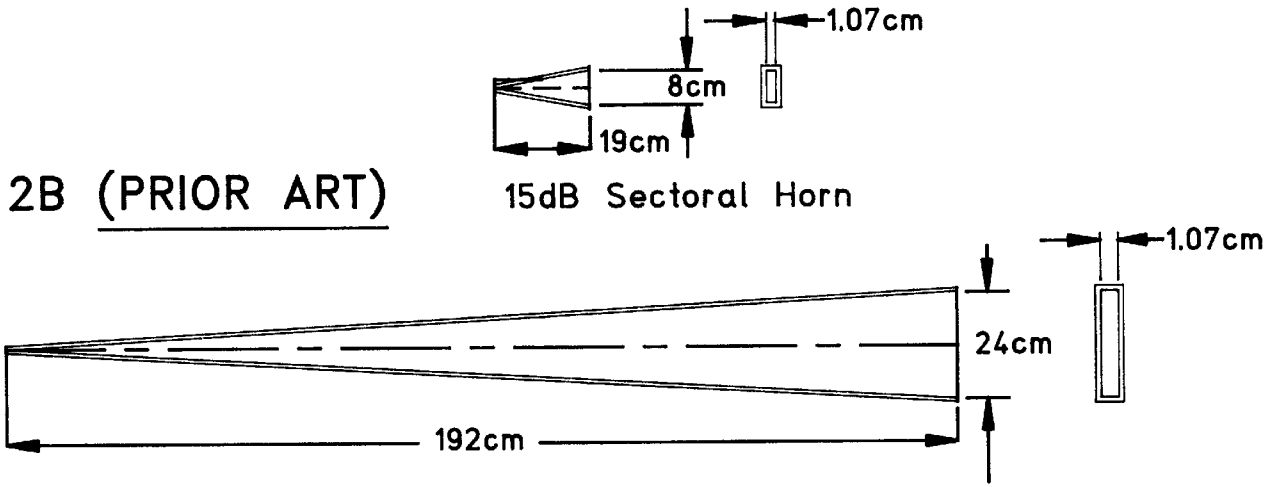
FIG. 2B (PRIOR ART)
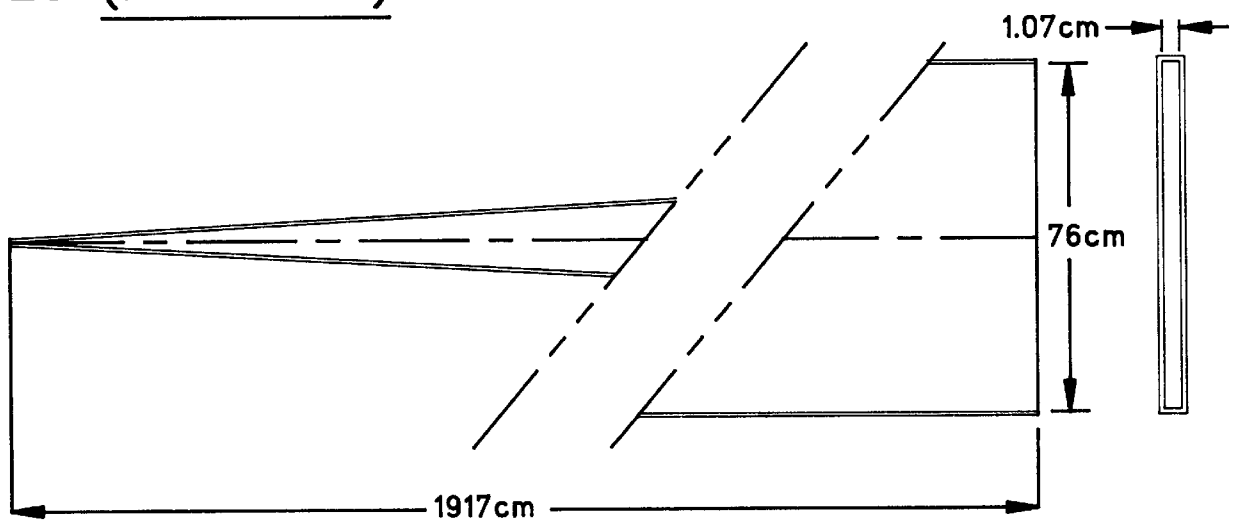
FIG. 2C (PRIOR ART)
FIG. 2D (PRIOR ART)

COMPACT WAVEGUIDE HORN ANTENNA AND METHOD OF MANUFACTURE

BACKGROUND OF THE INVENTION

The present invention relates to waveguide antennas and more particularly to rectangular and parabolic waveguide horn antennas.

Waveguide horn antennas are commonly used in wireless telecommunication systems to transmit and/or receive electromagnetic signals. FIG. 1 illustrates one such system in which four rectangular horn antennas are positioned 90° apart. In this configuration, each antenna is designed to have a 90° coverage area axially (±45°) to obtain a 360° total coverage area, and a vertical coverage area defined by the $\sec^2\theta$ beam pattern, known in the art.

One type of horn antenna used in this type of system is the conventional rectangular horn antenna 200, shown in FIG. 2A. The rectangular horn antenna has a body of length L and an output aperture 230 of height H and width W. The body also includes a source aperture 220 located at the back of the horn 210. The source aperture 220 may be a waveguide launch as shown or a coaxial launch as known in the art. Vertically or horizontally polarized waves my be launched from the rectangular horn antenna 200, depending upon the orientation of the applied signal.

The dimensions L, H, and W of the conventional antenna are dictated by several factors. The area of the output aperture 230 (H×W) determines the amount of antenna gain the horn will exhibit. The larger the output aperture 230, the more gain the antenna will exhibit.

The length of the horn antenna (L) is dictated by the requirement of phase coherent operation, i.e., signals must have a substantially planar wavefront when received at the source aperture 220 or transmitted from the output aperture 230. Because some of the received/transmitted signals will travel along the contours of the waveguide body and some along a direct (boresight) path, the horn must be long enough such that these two paths are substantially the same. These two paths converge as the horn length increases and diverge as the output aperture increases. Thus, as the output aperture area increases (to allow for more antenna gain), the horn length must also increase to maintain phase coherent operation.

FIGS. 2B–2D illustrate side views of three conventional rectangular horns having 15 dB, 20 dB, and 25 dB, of antenna gain, respectively. These figures indicate the degree to which the length of the conventional rectangular horn must by increased for higher gain operation. Each of the horns has an output aperture width of 1.07 cm.

As can be observed from the FIGS. 2B–2D, the horn length dramatically increases with increasing gain. The 20 dB gain horn is ten times as long as the 15 dB horn, and the 25 dB horn is approximately 100 times as long, measuring approximately 2 m long. While high gain, phase coherent horns are needed in telecommunication systems such as the base station shown in FIG. 1, their long length makes them extremely impractical.

What is needed is a compact waveguide antenna horn which provides high gain and phase coherent operation.

SUMMARY OF THE INVENTION

The present invention provides a compact waveguide horn antenna for providing high gain while requiring less length and volume compared with conventional rectangular horn antennas.

In one embodiment, the compact horn antenna consists of a parabolic rectangular horn antenna. The parabolic horn antenna includes a source aperture, a parabolic reflector, and a output aperture. The source aperture has a first port for receiving a planar wavefront signal and a second port for providing a substantially cylindrical wavefront signal. The parabolic reflector is positioned to receive the cylindrical wavefront signal and transforms it into a substantially planar wavefront signal at the output aperture. The output aperture is used to transmit the substantially planar wavefront signal.

In a second embodiment, the compact horn antenna consists of a shortened rectangular antenna. The shortened rectangular horn antenna a waveguide body and a dielectric lens. The waveguide body has a source aperture at a first end and an output aperture at a second end. The dielectric lens is disposed within the second end of said waveguide body to delay communicated signals. The dielectric lens forms a concave shape to equalize the effective signal paths between the source and output apertures.

The invention will be better understood by reference to the following detailed description in connection with the accompanying drawings.

BRIEF DESCRIPTION OF THE DRAWINGS

FIGS. 2B–2D illustrate side views of conventional rectangular horn having 15 dB, 20 dB, and 25 dB antenna gain, respectively.

DETAILED DESCRIPTION OF EXEMPLARY EMBODIMENTS

Figure 3A:
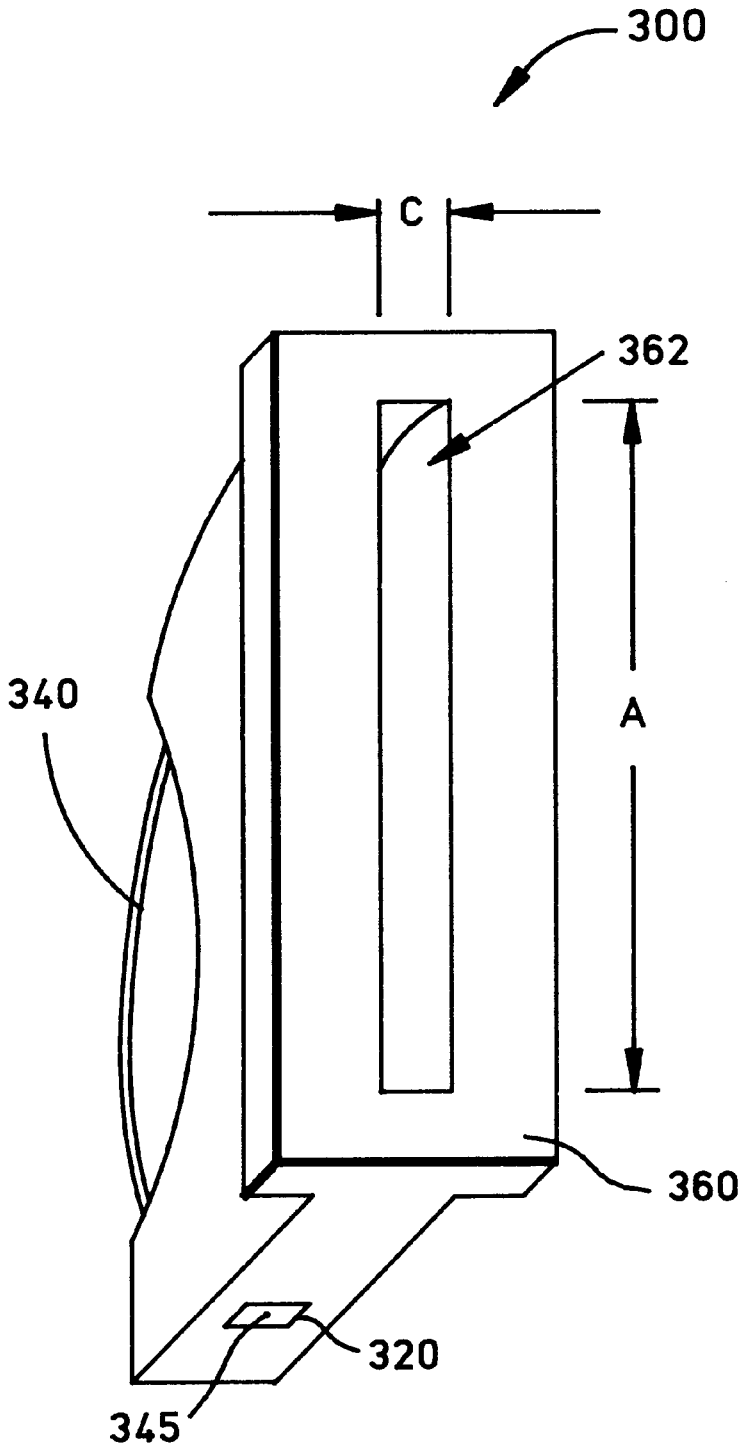
FIG. 3A illustrates one embodiment of the present invention consisting of a parabolic rectangular horn antenna.

FIG. 3A illustrates one embodiment of the present invention consisting of a parabolic rectangular horn antenna. The parabolic antenna 300 includes a source aperture 320, a parabolic reflector 340, and an output plate 360 having an output aperture 362.

During signal transmission, a signal is feed into the source aperture 320, located at a focal point 345 of the parabolic reflector 340. The source aperture 320 perturbs the phase of the signal, transforming the signal's planar wavefront into substantially a cylindrical wavefront as the signal propagates into the horn. As the signal's cylindrical wavefront reaches the parabolic reflector 340, the parabolic shape of the reflector 340 transforms the signal's cylindrical wavefront into a substantially planar wavefront. When the signal arrives at the output aperture 362, the wavefront of the signal is returned to a substantially planar wavefront. The parabolic shape of the reflector 340 returns the source or received signal to its substantially planar wavefront without requiring a long horn length. A large output aperture height may be used to allow for a high antenna gain while the horn length is substantially reduced. The parabolic rectangular horn antenna 300 operates in a reciprocal manner during reception of an incoming signal, providing a substantially linear wavefront signal to the source aperture 320.

Figure 3B:
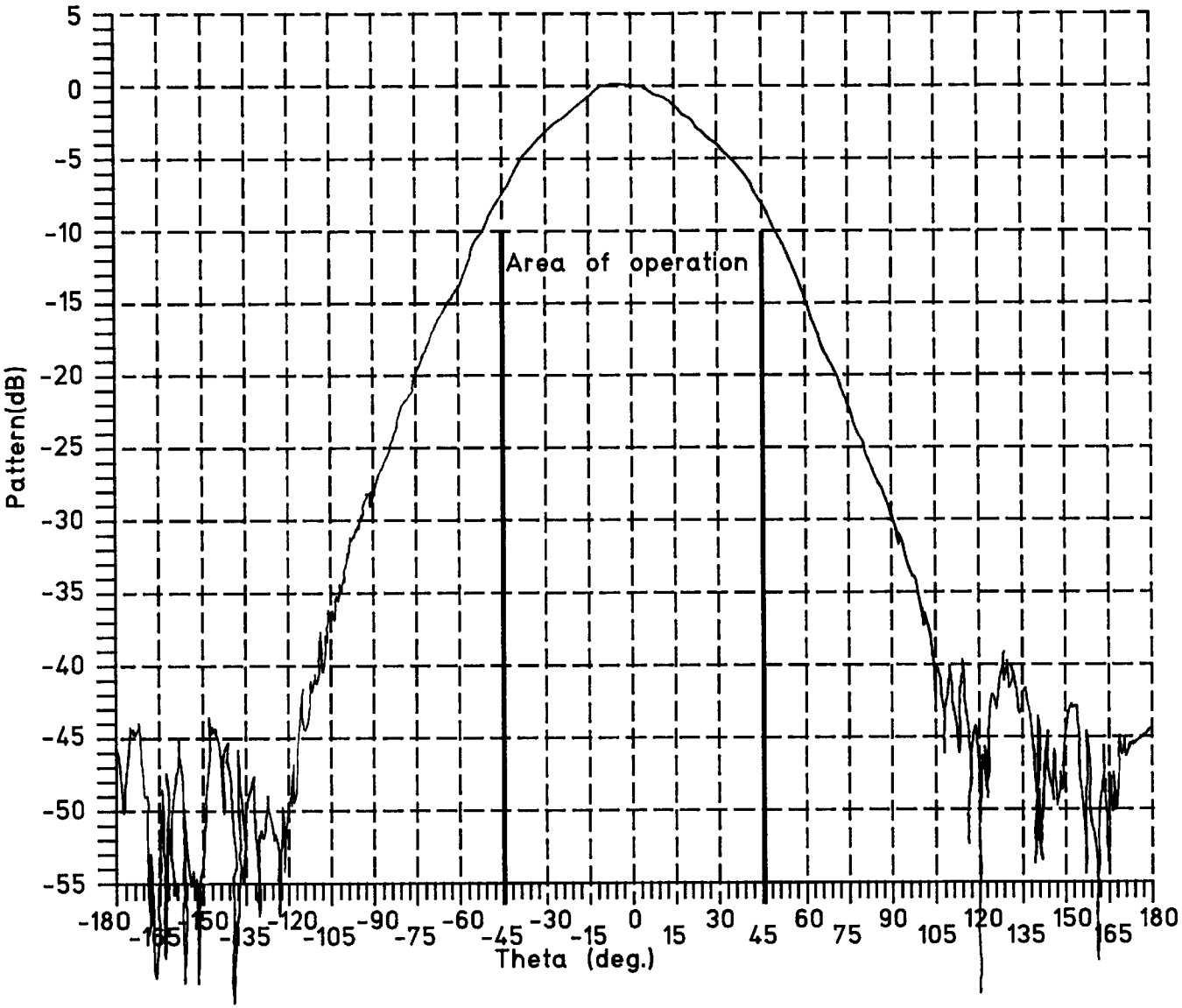
FIG. 3B illustrates the azimuth beam pattern of the parabolic rectangular horn of FIG. 3A.

FIG. 3B illustrates the azimuth beam pattern for the parabolic rectangular antenna over a 90° coverage area. The beam pattern exhibits a typical sinc response, indicating that the signal has a substantially planar wavefront. However, the azimuth beam pattern exhibits −10 dB signal variation over the desired coverage area (±45°). This signal variation is undesirable since the system's required power level is determined by the minimum antenna gain within the covered region. In this instance, the minimum power level is 10 dB lower at the edges than at the center of the coverage area. Consequently, a large amount of additional power will be needed to make up for this decrease in antenna gain.

Figure 3C:
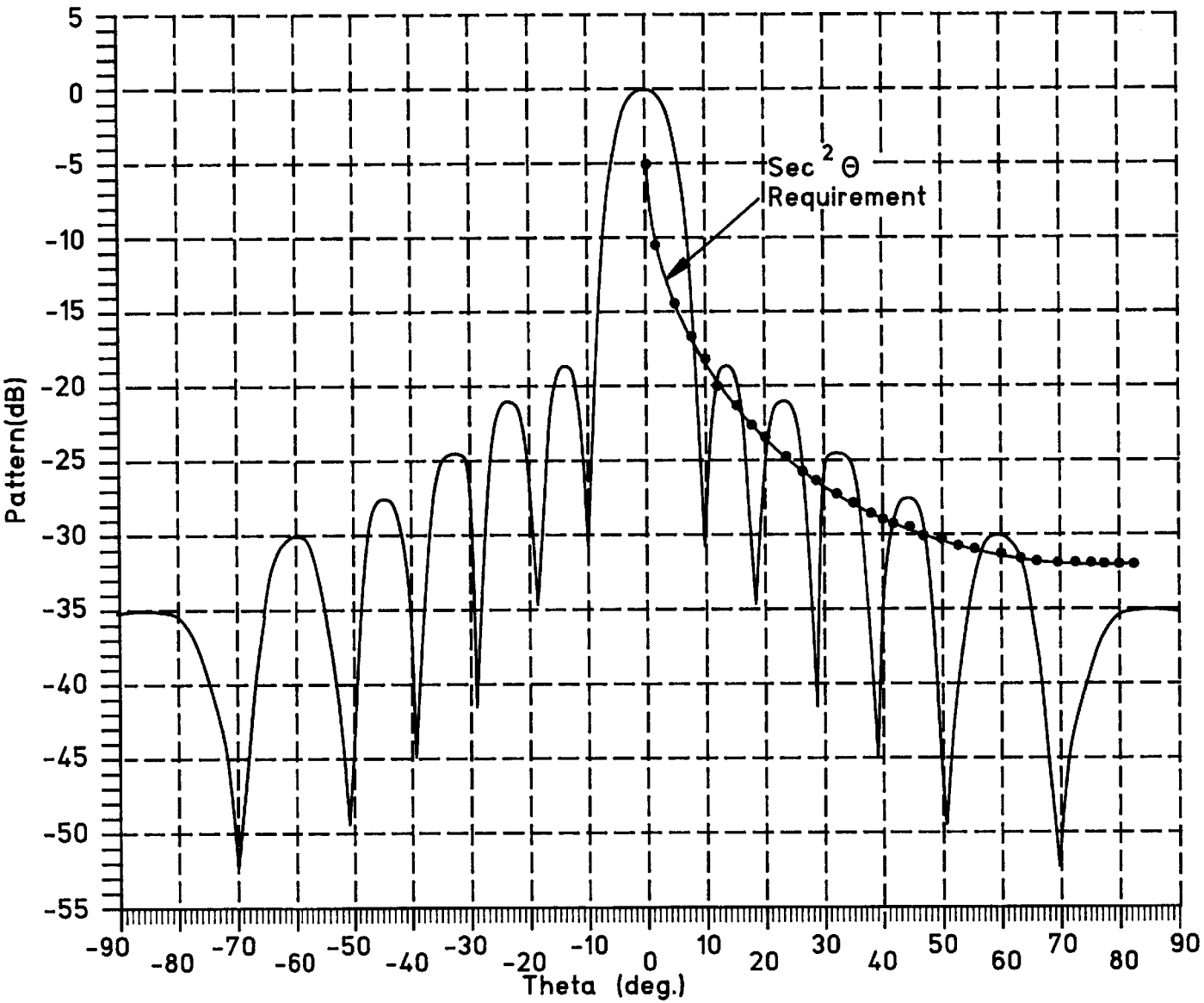
FIG. 3C illustrates the elevation beam pattern of the parabolic rectangular horn of FIG. 3A.

FIG. 3C illustrates the elevation beam pattern for the parabolic antenna over the 90° coverage area. The elevation beam pattern corresponds to the major axis of the output aperture and also exhibits a well-defined sinc pattern indicating wavefront planarity. The elevation beam pattern exhibits a response which is is generally similar to the desired $\sec^2\theta$ beam pattern. However, the elevation beam pattern exhibits high peaks and deep nulls caused by in-phase (0°) signal combination and anti-phase (180°) signal cancellation between the elevation angels of ±10°. The deep null response indicates that signals operating near these angels can experience significant fading.

Figure 4A:
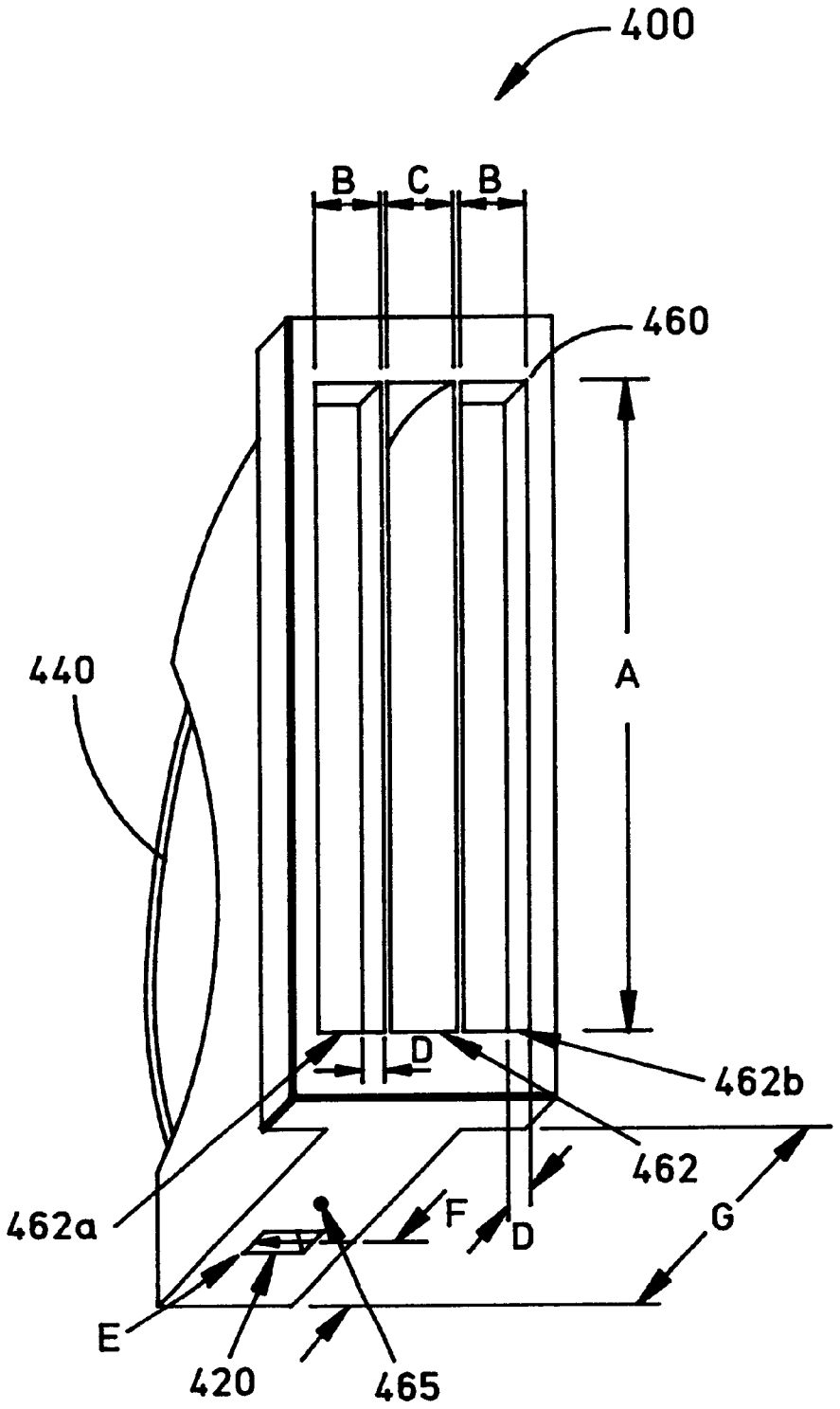
FIG. 4A illustrates a modified parabolic rectangular horn antenna in accordance with the invention.
Figure 4B:
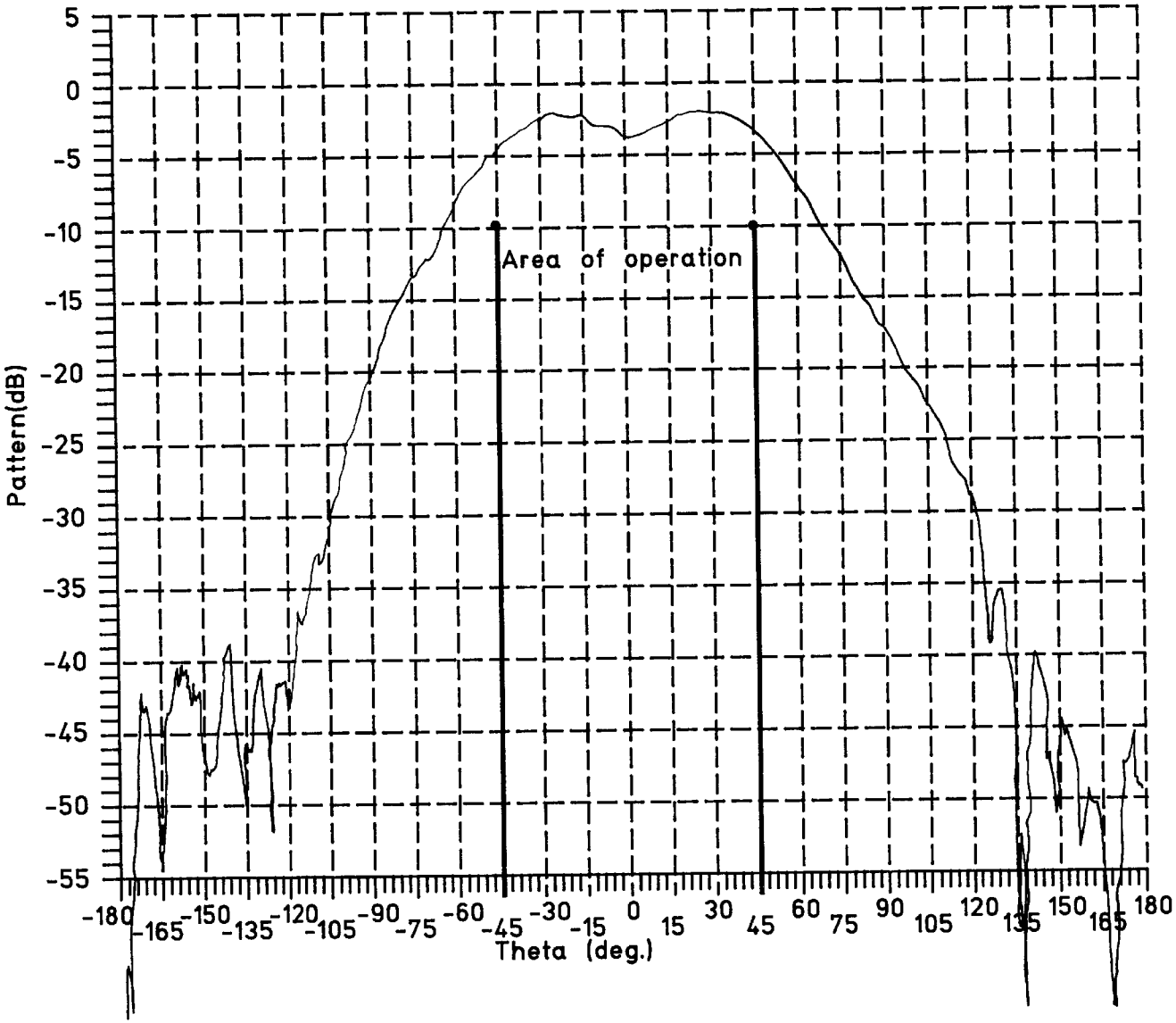
FIG. 4B illustrates the azimuth beam pattern of the improved parabolic rectangular horn antenna of FIG. 4A.

FIG. 4A illustrates a second embodiment of the parabolic rectangular horn antenna 400 which corrects for the peaked azimuth response and deep null elevation response shown in FIGS. 3B and 3C. The modified antenna 400 includes a source aperture 420, a parabolic reflector 440, and a output plate 460 having an output aperture 462. In addition, corrugations 462*a* and 462*b* are positioned laterally on both sides of the output aperture 462. The corrugations 462*a* and 462*b* form two adjacent radiator sections to produce a broader beam receiving/transmitting structure. As modified, the parabolic rectangular horn antenna generates a more uniform azimuth beam pattern (±1.5 dB) over the desired area of coverage (±45°), as shown in FIG. 4B. Additional corrugations may be used to produce a more uniform azimuth beam pattern response.

Figure 4C:
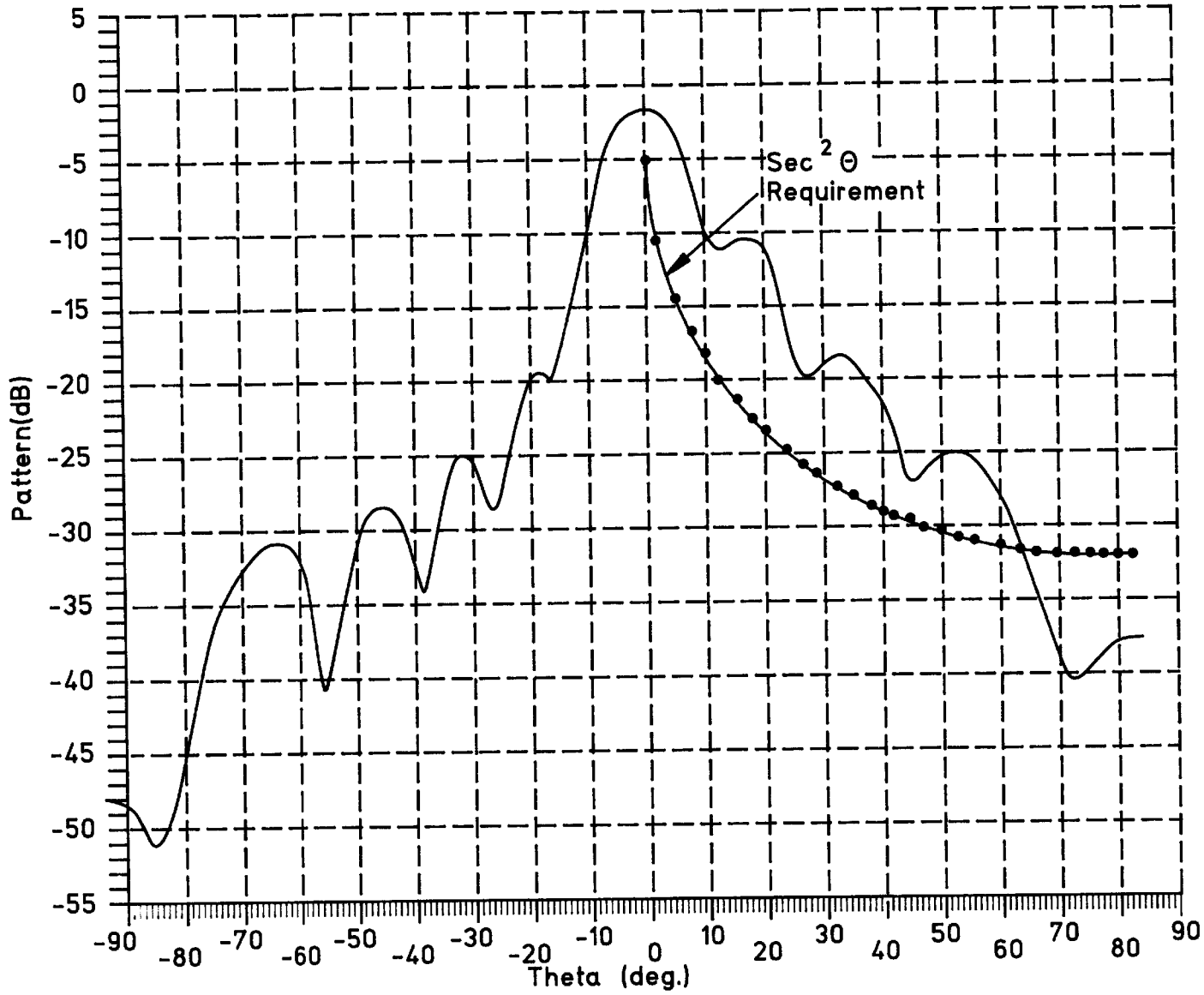
FIG. 4C illustrates the elevation beam pattern of the improved parabolic rectangular horn antenna of FIG. 4A.

The modified antenna of FIG. 4A also includes a source aperture 420 which is defocused, i.e., offset from the focal point 465 of the parabolic reflector 440 to reduce the peaks and nulls occurring within the elevation beam pattern as shown in FIG. 3C. When the source aperture 420 is defocused, transmitted and received signals become phase incoherent and signal combination and cancellation does not occur exactly in-phase or anti-phase. The phase offset results in a mitigated signal combination and cancellation effect, and less severe peaks and nulls in the elevation beam pattern. The resulting elevation beam pattern more closely approximates the desired $\sec^2\theta$ beam pattern, as shown in FIG. 4C.

In the illustrated embodiment, the antenna 400 is designed to operate at a center frequency of 25 GHz and may be configured to communicate horizontally or vertically polarized signals. Table I lists the physical dimensions of horizontally and vertically polarized versions of the parabolic rectangular horn antenna of FIG. 4A, drawn substantially to scale. The parabolic rectangular horn of FIG. 3A, also drawn substantially to scale, may be of a similar size but does not include adjacent corrugations or a defocused source aperture.

TABLE I

| Dimension | Horiz. Polarized Antenna | Vert. Polarized Antenna |
|---|---|---|
| A | 300 mm | 300 mm |
| B | 6.0 mm | 6.6 mm |
| C | 4.3 mm | 6.6 mm |
| D | 2.0 mm | 4.0 mm |
| E | 10.6 mm (w) × 4.3 mm (1) | 4.3 mm × 6.6 mm |
| F | 130 mm | 130 mm |
| G | 420 mm | 420 mm |

The listed dimensions were derived iteratively from initial dimensions of $A=25\lambda$, $B=0.5\lambda$, $C=0.25\lambda$, and $D=0.25\lambda$, where $\lambda$ is the wavelength of the desired center frequency of operation. Of course, one of skill in the art could identify different dimensions to enable operation at higher or lower frequencies.

Other techniques may be used as an alternative to or in combination with the aforementioned defocusing technique to approximate the desired $\sec^2\theta$ elevation beam pattern. For instance, the surface of the parabolic reflector 440 may be altered so that signals reflected therefrom are phase incoherent. The phase offset produces the mitigated signal combination and cancellation effects, described above as shown in FIG. 4C. The surface of the parabolic reflector 440 may be altered in an number of ways to introduce a non-uniform signal path length and produce the desired phase offset. One way to accomplish this would be to impregnate or coat the surface of the parabolic reflector 440 with a phase dispersive RF reflective material. Alternatively, the shape of the parabolic reflector 440 may be modified to introduce varying signal path lengths to produce the same phase offset effect.

Figure 5:
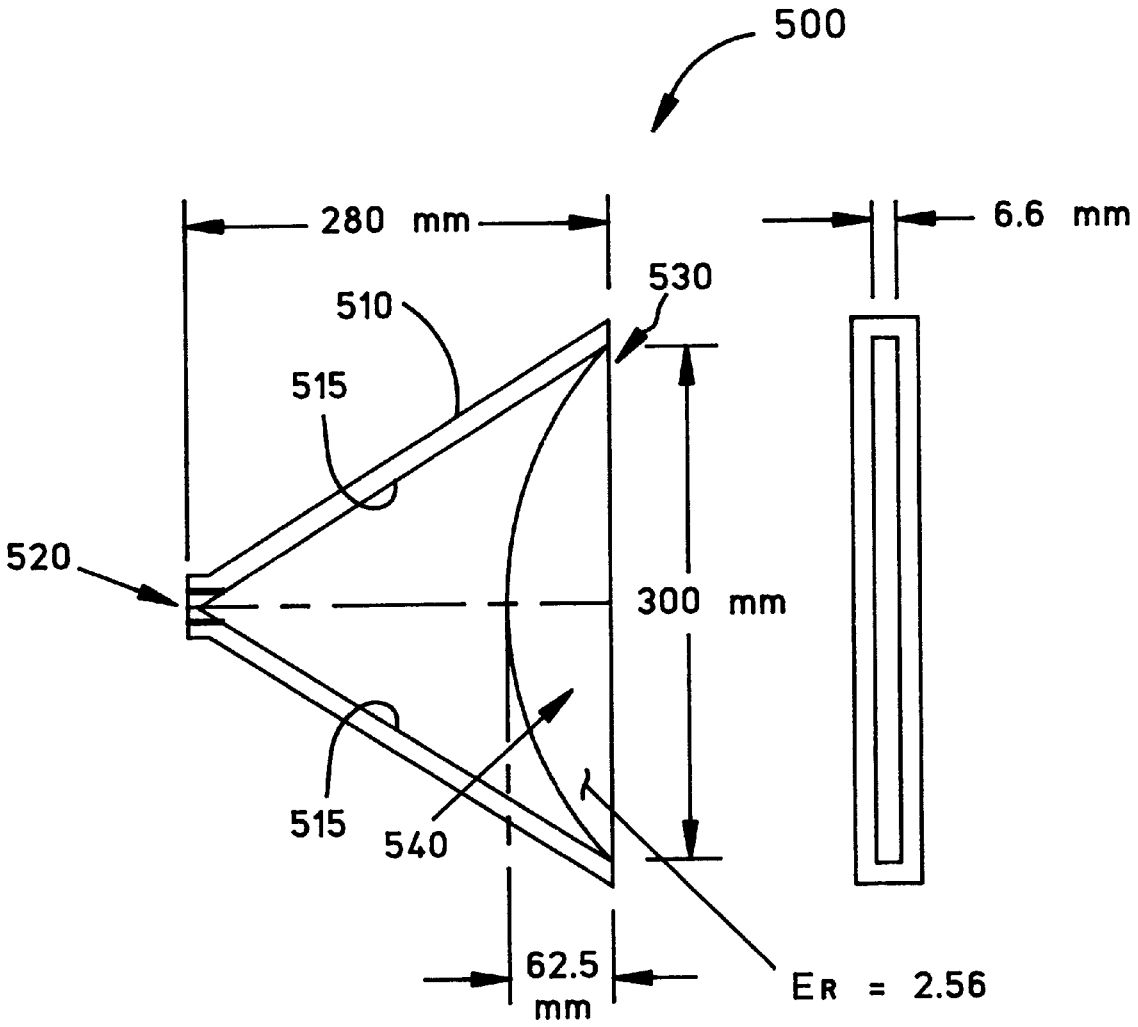
FIG. 5 illustrates a second embodiment of the present invention consisting of a shortened rectangular horn antenna.

FIG. 5 illustrates a shortened rectangular horn antenna in accordance with the present invention. The shortened rectangular horn antenna 500 produces substantially the same azimuth and elevation beam patterns as illustrated in FIGS. 4B and 4C, and includes a source aperture 520, a shortened waveguide body 510, and a dielectric lens 540 disposed within an output aperture 530. As illustrated in FIG. 5, the shortened rectangular horn 500 is drawn substantially to scale.

Figure 2A:
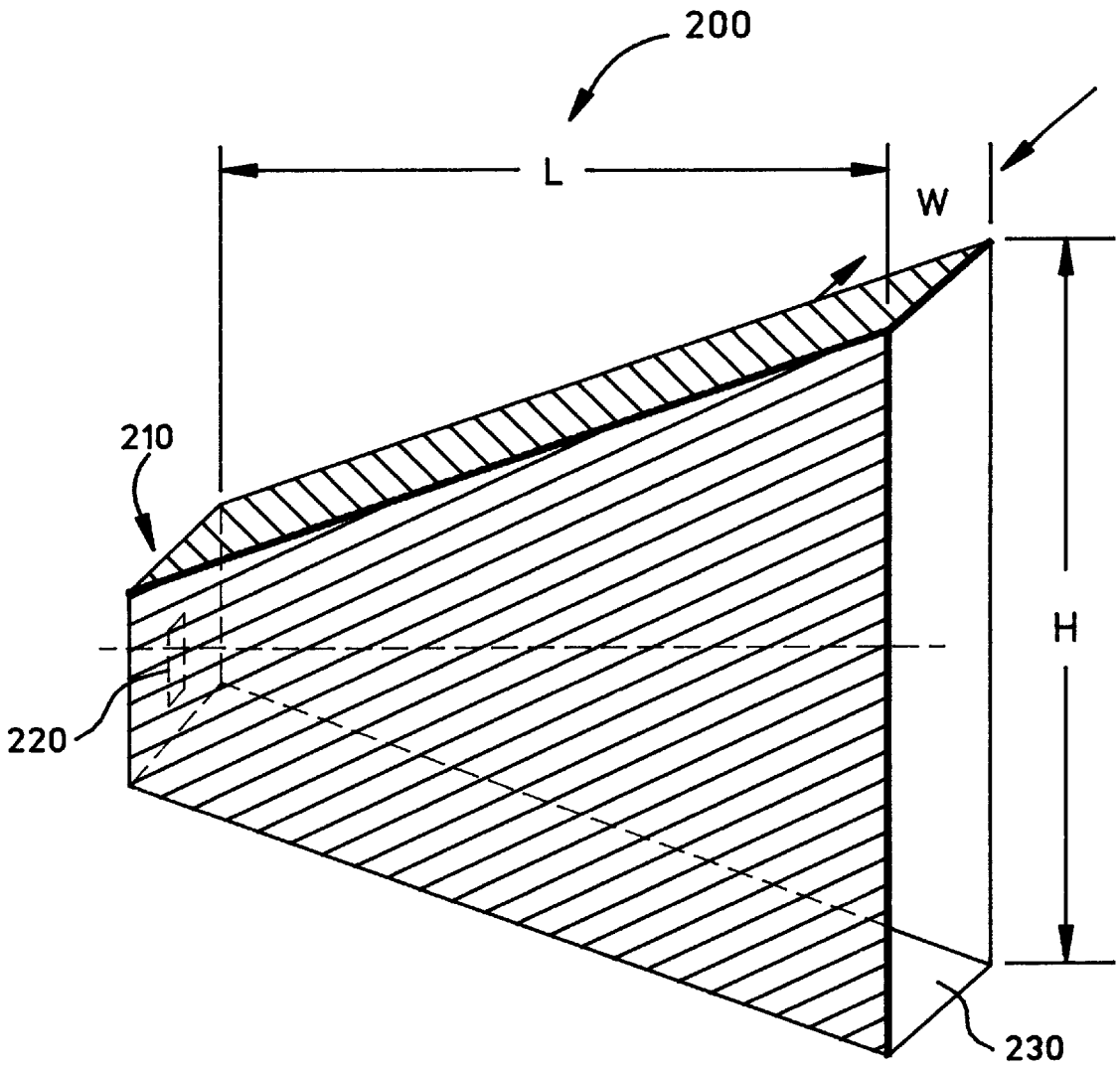
FIG. 2A (PRIOR ART)
FIG. 2A illustrates a conventional rectangular horn antenna.

The large output aperture 530 provides high gain, while the horn length is relatively short in comparison to the conventional rectangular horn antennas, shown in FIG. 2. The ratio of horn length to output aperture height to waveguide length is less than 8:1, and in the preferred embodiment of FIG. 5 is approximately 1:1.

Figure 1:
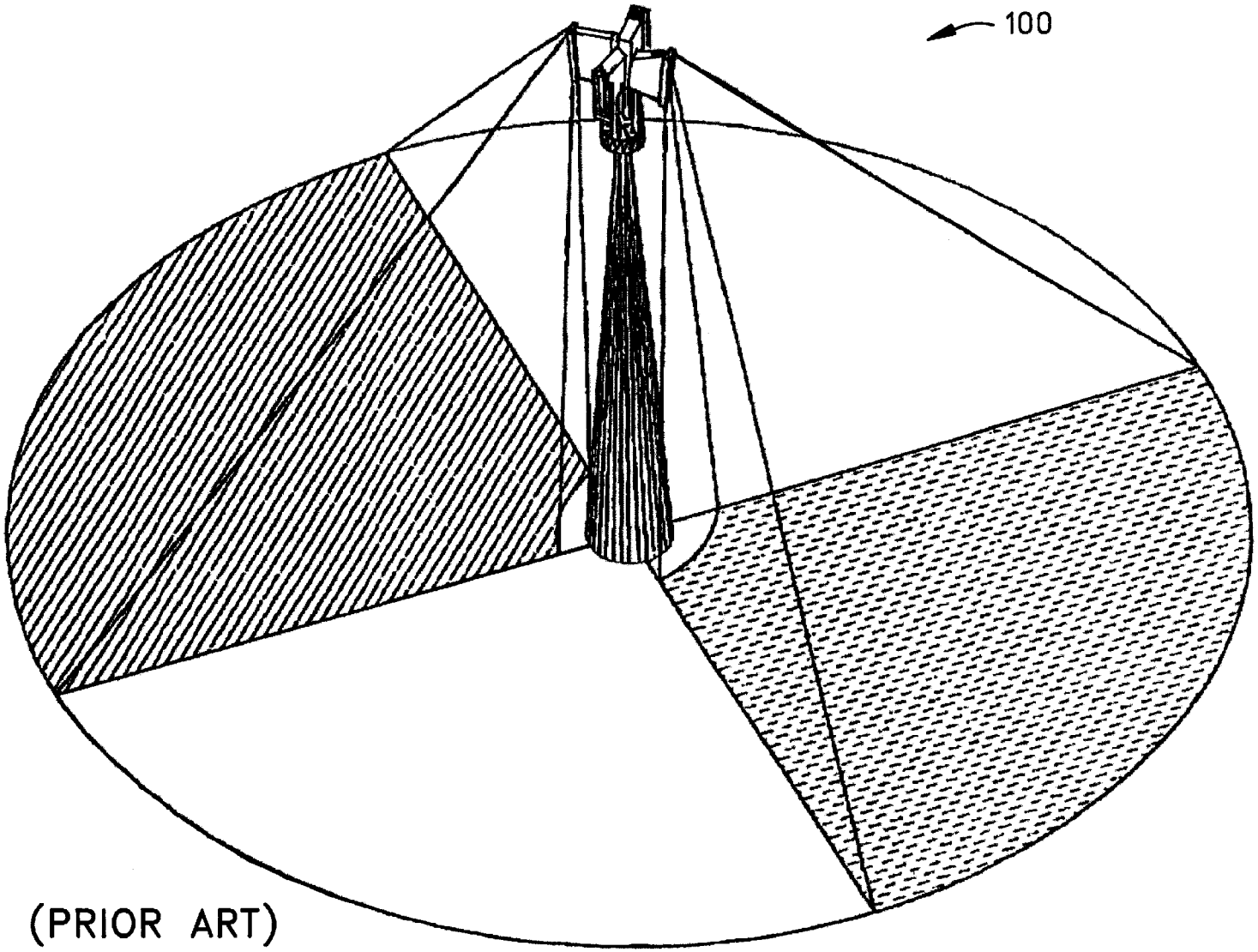
FIG. 1 (PRIOR ART)
FIG. 1 illustrates a conventional antenna array used for communicating signals to and from a base station.

Phase coherency is maintained by use of a concave-shaped dielectric lens 540 disposed within the shortened waveguide body 510. In the preferred embodiment, the dielectric lens is 62.5 mm thick at its center and has a dielectric constant of 2.56. The dielectric lens' concave shape operates to delay the boresight signals so that they travel effectively the same distance as signals propagating along the waveguide body contours 515. Signals propagating further off boresight travel through a thinner portion of the lens, resulting in less applied delay. In this manner, the signals communicated between the source aperture 520 and the output aperture 530 travel the same effective distance, and as such, are substantially phase coherent. The shape, thickness, and dielectric constant of the dielectric lens 540 is chosen to provide the correct amount of delay. The thickness and/or dielectric constant of the dielectric lens may altered and used with the illustrated horn or with horns of other dimensions to provide the desired antenna gain and phase coherence. The shortened rectangular horn antenna 500 may be used as a single transmitting/receiving element or implemented in the antenna assembly of FIG. 1, as described above.

In addition, the surface or content of the dielectric lens 540 may be altered to avoid the deep null elevation beam pattern shown in FIG. 3C. As described above, the deep nulls results from the signal combination and cancellation effect, and the surface of the dielectric lens may be altered to provide a slightly asymmetrical delay to signals propagating through the lens. This delay will produce a slight phase offset to mitigate the signal cancellation and combination effect, resulting in a response closely approximating the desired $\sec^2\theta$ beam pattern, shown in FIG. 4C.

Conventionally, the above-described parabolic rectangular horn antenna is manufactured by precision machining techniques known in the art. High frequency components are often machined due to the very tight tolerances needed for high frequency operation. However, precision machining is expensive and an alternative technique is to cast the structure. Casting represents a substantially lower cost method of manufacturing since once the mold is made, each part may be fabricated easily in contrast to machining a new part.

Casting, however requires tapering the portions of the structure to allow placement and removal of molds within the structure. Unfortunately, tapering portions of the structure deteriorates electrical performance. As a result, casting has not been employed to a significant degree in the manufacture of high frequency components such as the above-described parabolic rectangular horn antenna.

Figure 6:
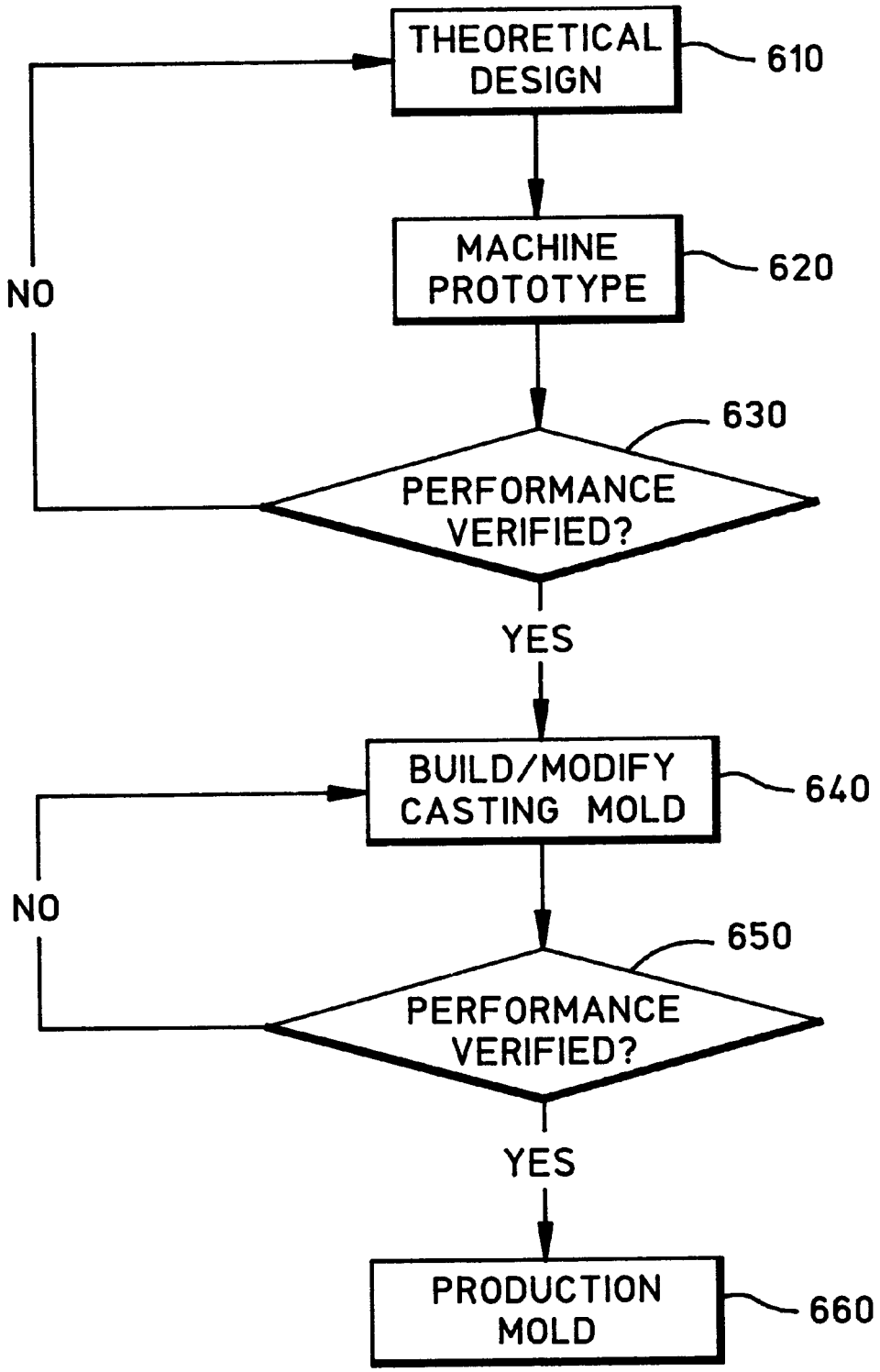
FIG. 6 illustrates a flow chart describing the method of manufacturing the compact waveguide horn antennas in accordance with the present invention.

FIG. 6 illustrates a method for manufacturing the parabolic rectangular horn antenna of the present invention by casting techniques. Initially at step 610, the theoretical design is developed using conventionally known techniques. Once the theoretical design is finalized, a prototype is precision machined (step 620) using conventionally known techniques such as numerically controlled (NC) machining.

Once machined, the measured performance of the prototype is compared with the simulated performance (step 630). If the measured performance is within an acceptable window relative to the desired performance, a casting mold of the parabolic rectangular horn antenna is made (step 640). The casting mold is substantially similar to the engineer drawings of the machined structure, the exception being that the internal walls are tapered to allow placement and removal of casting mold into and from the antenna structure.

Subsequently, the cast antenna is formed and its performance measured (step 650). If the measured performance is within an acceptable window relative to the predicted performance, the casting molds become the production molds from which additional antenna horns are manufactured (step 660). If the measured performance of the cast antenna is outside of the acceptable window, the casting molds are modified and the antenna is re-manufactured. Steps 640 and 650 are repeated until the measured performance of the cast antenna is within an acceptable range.

The invention has now been explained with reference to specific embodiments. Other embodiments will be apparent to those of ordinary skill in the art in view of the foregoing description. It is therefore not intended that this invention be limited except as indicated by the appended claims and their full scope of equivalents.

What is claimed is:

1. A parabolic antenna comprising:

a antenna body having a signal source aperture, a signal output aperture, and a plurality of corrugations located on the external periphery of said signal output aperture; and a parabolic reflector positioned within said antenna to communicate signals between said signal source aperture and said signal output aperture.

2. The parabolic antenna of claim 1, wherein said parabolic antenna defines a focal point which is offset from said source aperture.

3. The parabolic antenna of claim 1, wherein said parabolic antenna comprises a dispersive surface capable of producing incoherently-phased signal when illuminated.

4. The parabolic antenna of claim 1, wherein said plurality of corrugations are positioned parallel to the major axis of said output aperture.

5. A parabolic antenna, comprising:

a antenna body having a signal source aperture and a signal output aperture; and a parabolic reflector positioned within said antenna to communicate signals between said signal source aperture and said signal output aperture, wherein said parabolic reflector comprises a dispersive surface capable of producing incoherently-phased signals when illuminated.

6. The parabolic antenna of claim 5, wherein said antenna body further comprises a plurality of corrugations located on the external periphery of said signal output aperture.

7. The parabolic antenna of claim 6, wherein said corrugations are positioned parallel to the major axis of said output aperture.

8. An antenna array comprising a plurality of parabolic antennas, each of the parabolic antennas comprising:

a antenna body having a signal source aperture, a signal output aperture, and a plurality of corrugations located on the external periphery of said signal output aperture; and a parabolic reflector positioned within said antenna to communicate signals between said signal source aperture and said signal output aperture.

9. The parabolic antenna of claim 8, wherein said parabolic antenna defines a focal point which is offset from said source aperture.

10. The parabolic antenna of claim 8, wherein said parabolic antenna comprises a dispersive surface capable of producing incoherently-phased signal when illuminated.

11. The parabolic antenna of claim 8, wherein said plurality of corrugations are positioned parallel to the major axis of said output aperture.

12. A method for fabricating a cast parabolic rectangular horn antenna, the method comprising the steps of:

developing a theoretical design of the parabolic rectangular horn producing a desired beam pattern response;

fabricating a machined antenna prototype based upon said developed theoretical design;

verifying the performance of said machined antenna prototype;

generating a casting negative based upon said machined antenna prototype;

fabricating a cast antenna prototype;

verifying the performance of said cast antenna prototype; and providing a production cast negative for producing a plurality of said cast parabolic rectangular horn antennas.

13. The method of claim 12, wherein said step of verifying the performance of said machined antenna prototype comprises the steps of:

measuring said beam pattern response of said machined antenna prototype;

if said beam pattern measured response is not within a predefined range of said desired beam pattern response, repeating said steps of developing a theoretical design and fabricating a machined antenna prototype.

* * * * *